United States Patent [19]

Zerbi

[11] 4,409,905

[45] Oct. 18, 1983

[54] DEVICE FOR MOVING THE TWO SLIDING DOORS OF A CAR OF A CONTINUOUS CABLE-WAY WITH AUTOMATIC CLAMPING

[75] Inventor: Pier C. Zerbi, Leini, Italy

[73] Assignee: Nuova Agudio S.p.A., Turin, Italy

[21] Appl. No.: 325,475

[22] Filed: Nov. 27, 1981

[30] Foreign Application Priority Data

Mar. 20, 1981 [IT] Italy ..... 67387 A/81

[51] Int. Cl.[3] ..... B61D 13/00; E05F 11/34

[52] U.S. Cl. ..... 105/329 S; 49/118; 49/362; 105/341

[58] Field of Search ..... 105/329 R, 329 S, 341, 105/343; 49/118, 362; 296/146

[56] References Cited

U.S. PATENT DOCUMENTS 1,215,573 2/1917 Otis ..... 49/118 X
3,439,454 4/1969 Stretton ..... 49/118 X
3,931,769 1/1976 Tauzin ..... 105/329 S

FOREIGN PATENT DOCUMENTS 611679 6/1979 Switzerland ..... 105/329 S

*Primary Examiner*—Randolph Reese
*Attorney, Agent, or Firm*—Sughrue, Mion, Zinn, Macpeak & Seas

[57] ABSTRACT

A device for controlling the movement of the two doors is housed in a tile-shaped elongate support which is disposed above the doorway and is pivoted about a horizontal axis extending longitudinally of the roof of the car. The tile-shaped support carries centrally an electric motor for rotating two screws which are situated on respective sides of the motor and are threaded in opposite directions. A nut is mounted on each screw to run longitudinally, and has a forked part which engages a draw-bolt carried by the respective door of the doorway. When the tile-shaped support is pivoted upwardly by hand from outside the car, each fork is disengaged from its respective bolt to allow the emergency opening of the doors.

5 Claims, 7 Drawing Figures

1
6
6a
10
13
5
12b
11
17
3b
18
14
15
16
8
7
34
35
24
3a
20
IV
12a
23
9

27
31
30
32
29

8
12a
9
5

DEVICE FOR MOVING THE TWO SLIDING DOORS OF A CAR OF A CONTINUOUS CABLE-WAY WITH AUTOMATIC CLAMPING

The present invention relates to a device for moving the two sliding doors of a car of a continuous cable-way with automatic clamping or catching.

As is known, this type of cable-way, termed a "cable-car", is a unidirectional cable-way in which the cars are connected to a continuously driven traction or supporting-traction cable by automatic clamping or catching.

When each car arrives at a station, it is released automatically from the cable and is supported by an overhead rail while it passes through a deceleration zone which enables the car to stop so that the passengers can alight. Continuing along the rail, the car is carried to a zone where the passengers board and, after this, there is an acceleration zone at the end of which the car automatically clamps or catches onto the cable and leaves the rail.

Until now, the devices used for controlling the opening of the doors at the zone where the passengers alight and the closing of the doors at the zone where the passengers board are based on the use of mechanical levers which are not very reliable, particularly with a build-up of ice.

The problem which is at the basis of the present invention is that of providing a device for moving the doors of a cable-car, which has a high degree of reliability even under unfavorable atmospheric conditions, and, particularly in the presence of ice, has a much reduced weight and size and allows station personnel to open the doors extremely simply and rapidly in an emergency.

This problem is solved by the fact that the device according to the invention comprises:

- a support structure extending above the doorway of the car and supported by the car so as to be pivotable about a horizontal, longitudinal axis between a lowered working position and a raised rest position, the structure being formed so as to act, in its working position, as a protecting cover for the moving device;
- an electric motor with two senses of rotation which is supported centrally on the support structure;
- two worm-screws with opposing threads, which are rotated by the electric motor and extend coaxially on opposite sides thereof;
- a nut cooperating with each screw, each nut being prevented from rotating to permit its axial displacement by the rotation of the respective screw;
- a drawing member extending upwardly from the upper edge of each of the sliding doors of the doorway, and
- each nut being formed so as to engage the drawing member carried by the respective door of the doorway when the support structure is in its lowered working position, and to disengage from the drawing member when the support structure is pivoted manually to its raised rest position.

Further characteristics and advantages of the present invention will be apparent from the detailed description which follows with reference to the appended drawings, which are provided purely by way of nonlimiting example and illustrate one embodiment schematically, in which.

Figure 1:
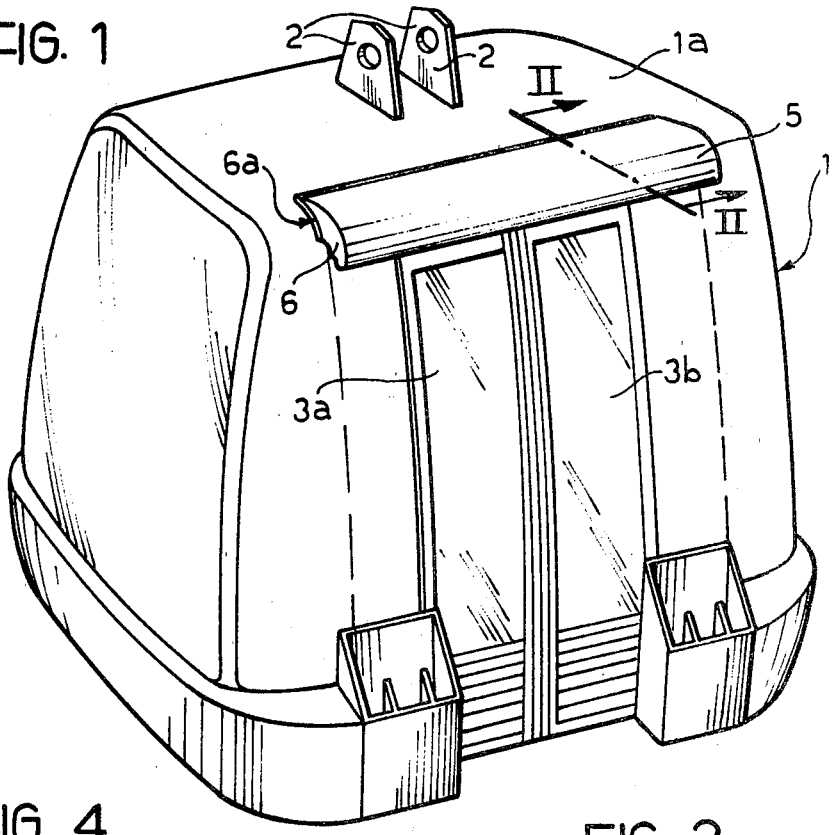
FIG. 1 is a perspective view of a cable-car provided with a device according to the invention.
Figure 4:
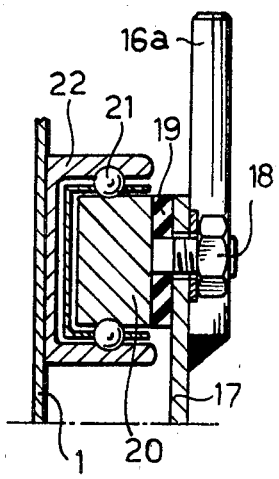
FIG. 4 is a section on an enlarged scale taken along the line IV—IV in FIG. 3.

With reference to FIGS. 1 to 5, there is shown a cable-car 1 provided on its roof 1*a* with an attachment 2 for the pivotal mounting of the car suspension arm, not illustrated.

The car 1 has a doorway with two sliding doors 3*a*, 3*b*.

A support element 5, in the form of an elongate tile extending horizontally above the doorway, is pivoted to the roof 1*a* of the car 1 about a longitudinal horizontal axis 4.

The tile-shaped support 5 has two end walls 6, the edges 6*a* of which match the profile of the car.

Figure 2:
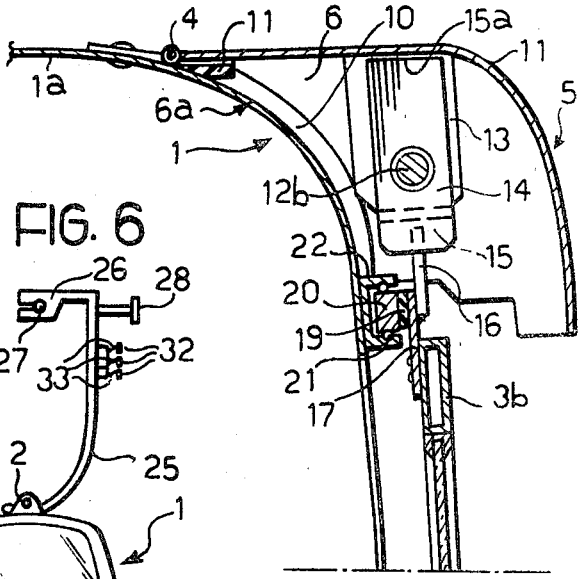
FIG. 2 is a section on an enlarged scale taken along the line II—II in FIG. 1.

The tile-shaped support 5 also carries a central resilient gripper member 34 which engages a catch member 35 carried by the car in the lowered working position of the support 5 shown in FIGS. 1 and 2.

An electric motor with two end plates 8 is fixed by screws 9 to the inside of the central part of the tile-shaped support 5.

The electric motor 7, which may operate, for example, with a variable current of between 12 and 24 volts, rotates two oppositely-threaded worm-screws 12*a*, 12*b* respectively, which extend coaxially on opposite sides of the motor 7.

The outer ends of the screws 12*a*, 12*b* are supported by bearings 13 carried by the end walls 6 of the tile-shaped support 5.

A nut 14 in the form of a parallelepiped block is engaged on each of the screws 12*a*, 12*b*, and has a forked-shaped end with two wall portions 15 disposed transverse the common axis of the two screws 12*a*, 12*b*.

The opposite end of each nut has a flat face 15*a* situated immediately adjacent a corresponding flat zone of the tile-shaped support 5.

Thus, the nuts 14 are prevented from rotating and are therefore displaced axially in opposite directions by the rotation of the rotor of the motor 7.

As will be described in greater detail below, the motor 7 is supplied in such a way as to be rotatable in opposite senses, to effect displacement of the two nuts 14 towards the motor 7 in one case, and displacement of the two nuts 14 towards the end walls 6 of the tile-shaped structure 5 in the other case.

When the tile-shaped support structure 5 is in its lowered working position, as illustrated in full outline in FIG. 2, each fork 15 engages a draw-bolt 16 connected to a support plate 17.

Each support plate 17 is fixed by a screw 18, with the interpositioning of a rubber plate 19, to a carriage 20 which, with the interpositioning of a sliding device 21, is slidable longitudinally in a guide channel 22.

The channel 22 is fixed to the wall of the car 1 adjacent the upper edge of the door opening.

Each of the support plates 17 is fixed to a respective sliding door 3*a*, 3*b* of the doorway.

A pair of microswitches 23, 24 are fixed within the tile-shaped support structure 5 and cooperate with one of the nuts 14 to cut off the supply to the motor 7 at the end of the opening and closing strokes, respectively, of the two doors *3a*, *3b*, which are controlled by the axial displacement of the nuts 14 through the respective draw-bolts 16. The microswitches 23, 24 may also supply signals to the effect that the opening or closing of the door has occurred, in order to ensure the correct operation of the system.

In an emergency (a breakdown of the electric motor 7, an interruption of the current supply to the motor or to rescue passengers in transit) the doors may be opened manually, and extremely simply, by service personnel.

In fact, it suffices to pivot the tile-shaped support structure 5 upwardly, rotating it about the pivot axis 4 so as to overcome the resistance of the resilient gripper member 34, to disengage the nuts 14 from the draw-bolts 16 and allow the manual opening of the doors.

The entire moving mechanism described above is effectively protected from the weather by the tile-shaped support 5 which has gaskets 10 at the edges *6a* and a gasket 11 at the edge which rests on the roof *1a*, thereby preventing the build-up of ice on the moving part of the mechanism itself when it is snowing.

Figure 6:
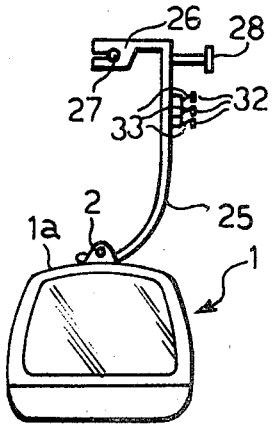
FIG. 6 is a schematic frontal view of the car and its suspension device.
Figure 3:
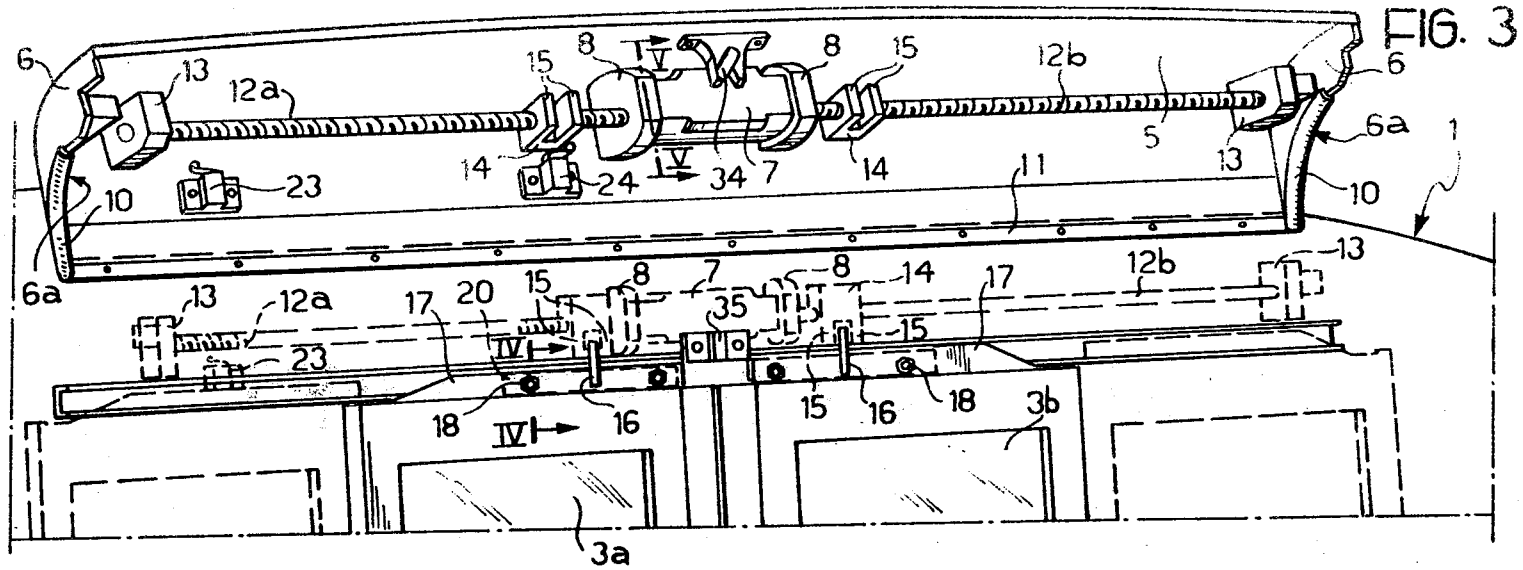
FIG. 3 is a perspective view of a moving device.
Figure 7:
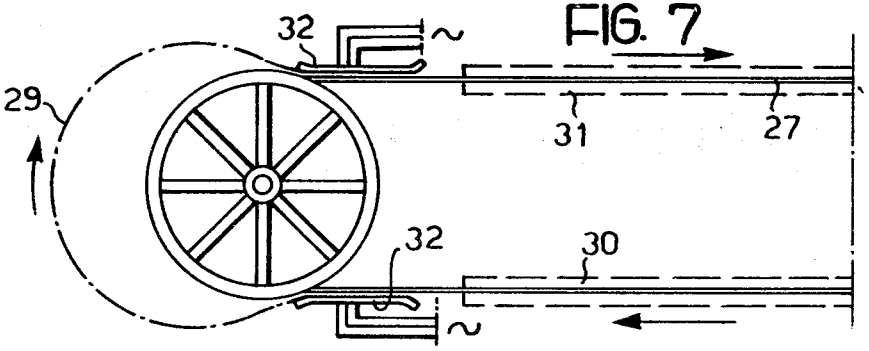
FIG. 7 is a schematic plan view illustrating the path of the cable and the car at a station.
Figure 5:
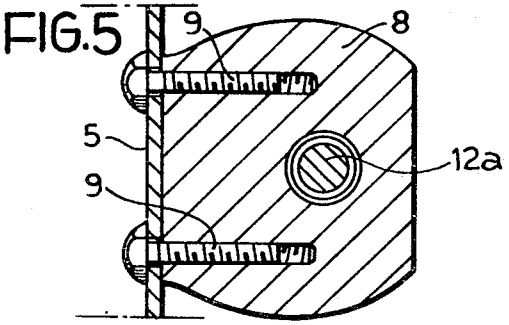
FIG. 5 is a section on an enlarged scale taken along the line V—V in FIG. 3.

Referring now to FIGS. 6 and 7, the suspension arm 25 of the car 1 carries at its upper end a device 26 for automatically clamping onto the cable 27, and a small wheel 28 for supporting the car on the overhead rail of a station.

FIG. 7 shows the path 29 of the car while it is supported by the overhead rail (not shown) between the deceleration zone 30 and the acceleration zone 31.

At the two zones where the passengers alight and board respectively, each station has three fixed conducting bars 32 which are supported resiliently and connected to an electricity supply network. The bus-bars 32 supply the electric motor 7 through spring contacts 33 carried by the suspension arm 25.

The polarities of the bus-bars are chosen so as to cause rotation of the motor 7 in the sense corresponding to opening of the doors *3a*, *3b*, in the zone where the passengers alight, and rotation of the motor 7 in the sense corresponding to closing of the doors in the zone where the passengers board.

Naturally, while the principle of the invention remains the same, the details of construction and the embodiments of the device may be varied widely from that described purely by way of non-limiting example without departing from the scope of the present invention.

I claim:

1. In a cable-car for a continuous cable-way with automatic clamping or catching, including two sliding doors, a device for moving said doors comprising:

a support structure extending above said doors and supported by said car so as to be rotatable about a horizontal longitudinal axis between a lowered working position and a raised rest position, said support structure acting as a protective cover for said device in said working position;

an electric motor rotatable in two senses and supported centrally on said support structure, two worm-screws with opposing theads, which are rotatable by said electric motor and extend coaxially on opposite sides of the latter;

a drawing member extending upwardly from the upper edge of each of said sliding doors, and a respective nut cooperating with each said screw and being prevented from rotating so as to be displaceable axially by rotation of the respective said screw, each said nut engaging the drawing member of a respective said door when said support structure is in said lowered working position, and being disengaged from said drawing member when said support structure is pivoted manually into said raised rest position.

2. A device as defined in claim 1, wherein said support structure is elongate and has end walls, said end walls carrying bearings for the ends of said screws opposite said motor.

3. A device as defined in claim 1, wherein each said nut comprises a fork extending transverse the axis of the respective said screw, and wherein each said drawing member comprises a bolt engageable by said fork in said lowered working position of said support structure.

4. A device as defined in claim 1, wherein said support structure carries a pair of micro-switches which cooperate with one of said nuts to cut off the supply to said motor at the end of the opening and closing strokes, respectively, of said doors controlled by said axial displacement of said nuts.

5. A cable-way including a number of stations, and a plurality of cars with two sliding doors, a suspension arm, and a device for moving said doors comprising:

a support structure extending above said doors and supported by said car so as to be rotatable about a horizontal longitudinal axis between a lowered working position and a raised rest position, said support structure acting as a protective cover for said device in said working position;

an electric motor rotatable in two senses and supported centrally on said support structure, two worm-screws with opposing threads, which are rotatable by said electric motor and extend coaxially on opposite sides of the latter;

a drawing member extending upwardly from the upper edge of each of said sliding door, and a respective nut cooperating with each said screw and being prevented from rotating so as to be displaceable axially by rotation of the respective said screw, each said nut engaging the drawing member of a respective said door when said support structure is in said lowered working position, and being disengaged from said drawing member when said support structure is pivoted manually into said raised rest position, wherein the improvement consists in:

each said station including two series of conducting bars connected to an electricity supply network and situated in respective zones where said cars arrive at and depart from said station, and each said suspension arm having spring contacts electrically connected to said electric motor and being slidable on the said bars, whereby the power supply to said motor is controlled so that the latter rotates in one sense when said car is in the arrival zone to open said doors, and in the opposite sense when said car is in the departure zone to close said doors.

* * * * *